US006044495A

United States Patent [19]

Ellman et al.

[11] Patent Number: 6,044,495

[45] **Date of Patent: *Apr. 4, 2000**

[54] DETACHABLE VISOR COVER FOR BASEBALL CAPS

[75] Inventors: Louis Ellman, 221-23 64th Ave., Bayside, N.Y. 11364; Neil Ellman, Queens, N.Y.

[73] Assignee: Louis Ellman, Bayside, N.Y.

[ * ] Notice: This patent issued on a continued prosecution application filed under 37 CFR 1.53(d), and is subject to the twenty year patent term provisions of 35 U.S.C. 154(a)(2).

[21] Appl. No.: 08/786,409

[22] Filed: Jan. 21, 1997

[51] Int. Cl.[7] ..... A42B 1/06

[52] U.S. Cl. ..... 2/195.1; 2/209.13

[58] Field of Search ..... 2/195.1, 209.13, 2/10

[56] References Cited

U.S. PATENT DOCUMENTS

| | | | |
|---|---|---|---|
| 5,070,545 | 12/1991 | Tapia | 2/195.1 |
| 5,410,761 | 5/1995 | Connelly et al. | 2/209.13 |
| 5,621,915 | 4/1997 | Schneider et al. | 2/195.1 |
| 5,689,830 | 11/1997 | Pflum | 2/195.1 |

FOREIGN PATENT DOCUMENTS

| | | | |
|---|---|---|---|
| 736700 | 11/1932 | France | 2/195.1 |

*Primary Examiner*—Diana Oleksa
*Attorney, Agent, or Firm*—Lackenbach Siegel

[57] ABSTRACT

A detachable visor cover (20) having the means for attachment built into the detachable visor cover (20) enabling the wearer of baseball/golf or like cap to slide on and slide off the detachable visor cover (20) by use of a slide/track system (30) that is affixed to the left side (30*a*) and the right side (30*b*) of the underside of the detachable visor cover (20).

6 Claims, 6 Drawing Sheets

DETACHABLE VISOR COVER FOR BASEBALL CAPS

BACKGROUND

1. Field of the Invention

This invention relates to headgear, specifically to the visor portion of a baseball cap.

2. Description of Prior Art

There have been various attempts in the prior art concerning detachable visors of baseball caps and other devices that allow the wearer of the cap to achieve a multitude of combinations, whether it be combinations of color, logos or both. The methods that have been developed in the prior art, although providing the wearer with the ability to achieve different looks, do not afford the wearer of the cap with a simple means of changing the look of the cap, whether it be color or logo without involving the taking apart of the cap in some way and putting it back together. In essence, one has to build one's cap and cannot make use of standard baseball caps that one might already own. This also means that one would have to purchase separate visors and cap portions, possibly in kit form in order to construct the cap to the look of their choice. Other methods involving inserts that are placed into plastic pockets that surround the visor, detract from the look of a standard cap and still involve a number of steps and components in order to change the look of the visor.

U.S. Pat. No. 5,070,545 to R. Tapia discloses a crown portion and various interchangeable portions. It also shows that insignia patches of various styles can be removably affixed to the selected visor and crown portions so that one cap assembly can be modified to identify with two or more athletic teams. For one, this method of achieving logo or color variation would mean that the wearer cannot make use of a standard cap for the device but rather would have to purchase a kit to build the cap. Secondly, this method does not allow for a quick change but rather involves assembling and disassembling the cap each time the wearer wishes to change the look. Using our system, which will be fully disclosed in the coming pages, involves providing the wearer of the cap with a method of achieving multiple looks, whether it be of color or logo without any need for hook and loop fasteners, buttons or snaps as the Tapia patent discloses, but rather, using a simplified one-piece all inclusive slide/track system that allows one to slide the visor cover over the existing visor to immediately change the look of the cap with the appearance of the detachable visor cover being the actual visor.

U.S. Pat. No. 5,410,761 to Connelly et al. discloses a visor with diverse pictorial displays placed in an insert that is located on the top surface of the visor. The insert is protected by a plastic envelope fastened to the visor with a strip of hook and loop material. For one, the main embodiment of the Connelly patent uses a plastic envelope as the means of holding in place the desired insert that the wearer chooses to display. The plastic insert takes on the appearance of an insert attached to the visor instead of one that gives the appearance of the actual visor itself As will be disclosed in the coming pages the one-piece all inclusive slide/track system will give the appearance of being the actual visor of the cap rather than taking on the appearance of an additional item being attached to the visor of the baseball cap.

OBJECTS AND ADVANTAGES

Accordingly, several objects and advantages of the present invention are:

(a) to provide a one-piece detachable visor cover that uses a slide/track system that one can use on one's existing caps that allows one to achieve variation in color and logo.

(b) to provide a detachable visor cover that does not require one to construct one's cap as a result of purchasing a kit but rather a situation where the wearer can purchase a multitude of detachable visor covers that would accommodate different sized visors.

(c) to provide a detachable visor cover that does not compromise the look of the cap but rather appears as part of the cap itself rather than an addition to the visor.

(d) to provide a detachable visor cover composed of one-piece of solid bendable material that does not involve the use of buttons, snaps, or hook and loop fasteners as the means of attaching the detachable visor cover to the visor portion but rather a system that allows the wearer to slide on or off the visor of their choice.

Further objects and advantages are to provide a one-piece all inclusive slide/track system that uses the least amount of parts and manipulation in order to achieve endless variation of color and logo.

DRAWING FIGURES

In accordance with the above description, which will become apparent hereinafter, the instant invention will now be described with reference to the accompanying drawings in which.

REFERENCE NUMERALS IN DRAWINGS

| | | | |
|---|---|---|---|
| 20 | Represents the detachable visor cover in its entirety. | 24 | Visor of standard baseball cap. |
| 30 | Slide/track system attached to the underside of the detachable visor cover. | 30(a) | Slide/track connected to the left side of the underside of the detachable visor cover. |
| 30(b) | Slide/track connected to the right side of the underside of the detachable visor cover. | 34 | Cap portion of the baseball cap. |

SUMMARY

A detachable visor cover for a baseball cap using a slide/track system that has the means for attachment built into the mold of the detachable visor cover itself allowing for the wearer to achieve endless variations of color and logo by sliding on the detachable visor cover of the wearer's choice thus eliminating multiple parts while requiring minimal manipulation.

MAIN EMBODIMENT DESCRIPTION DESCRIPTION—FIGS. 1 TO 6

Figure 1:
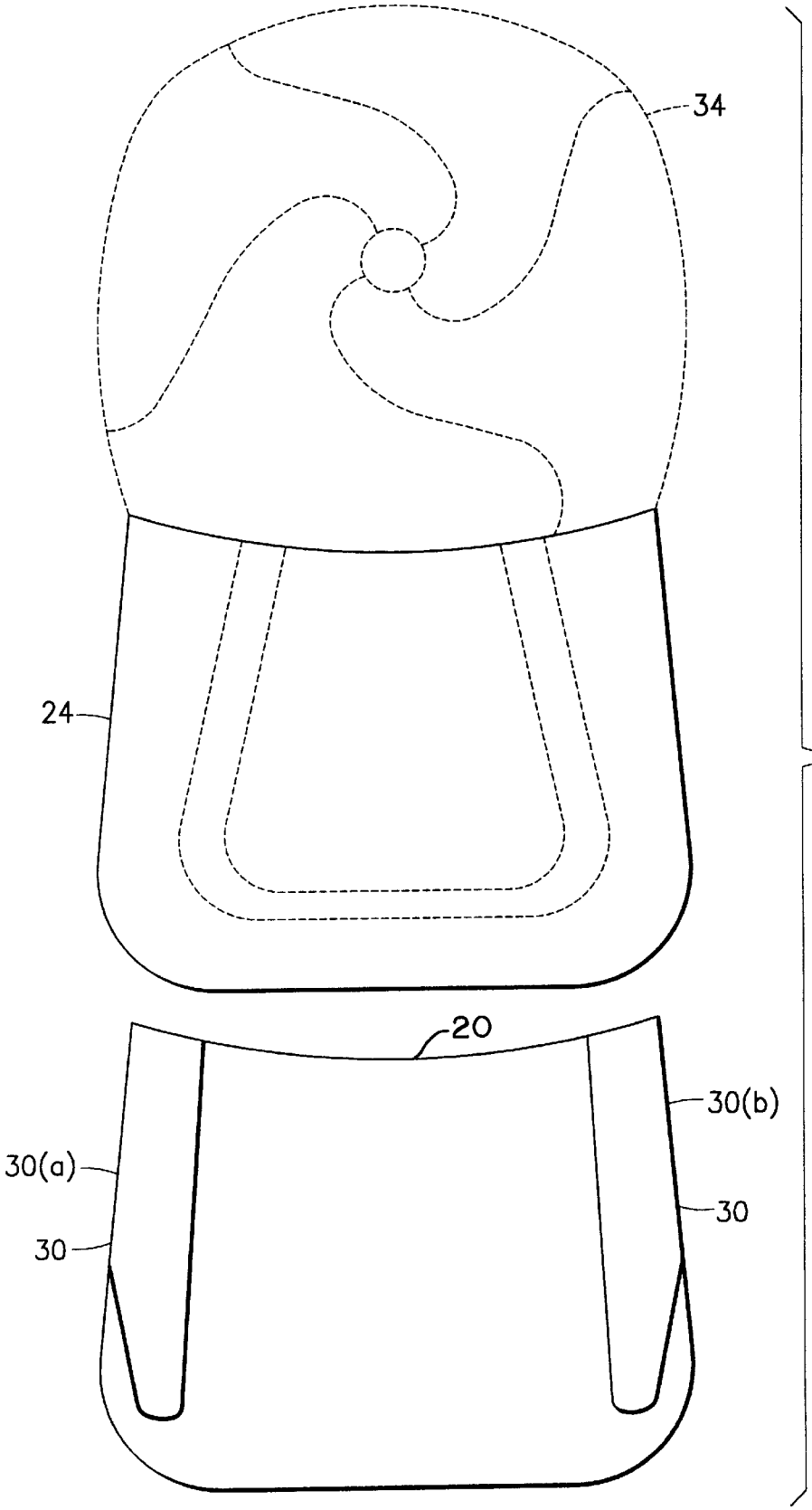
FIG. 1 is an underside exploded view of the detachable visor cover, and standard baseball cap.

Referring to the drawings, wherein like reference characters designate like or corresponding parts throughout the several views and referring particularly to FIG. 1, it is seen that the invention comprises a detachable visor cover, particularly for that of a baseball cap.

FIG. 1 shows an underside exploded view of the detachable visor cover designated by numeral 20, slide/track system designated by numeral 30, slide track groove affixed to the left side of the underside of the detachable visor cover designated by numeral 30(*a*), slide track groove affixed to the right side of the underside of the detachable visor cover designated by 30(*b*), the visor of a standard baseball cap designated by numeral 24 attached to the cap portion of a standard baseball cap designated by numeral 34.

Figure 2:
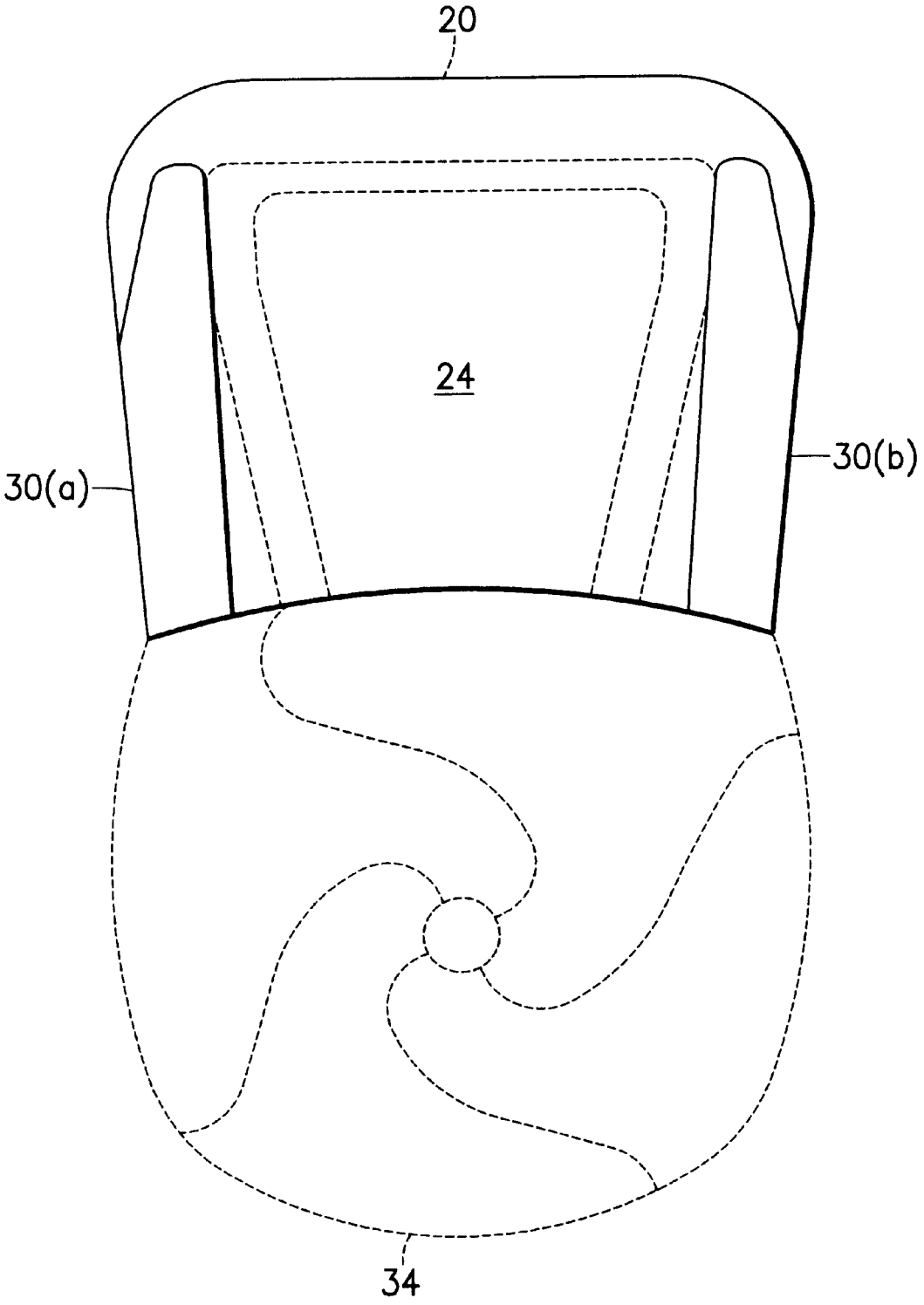
FIG. 2 is an underside view of the detachable visor cover showing both sides of the slide/track system connected to the visor of the baseball cap.

FIG. 2 shows an underside view of the detachable visor cover 20 showing both sides of the slide/track system designated by 30(*a*) and 30(*b*) representing the left and right side of the slide/track system respectively, connected to the visor of a baseball cap 24, attached to the cap portion of the standard baseball cap 34.

Figure 3:
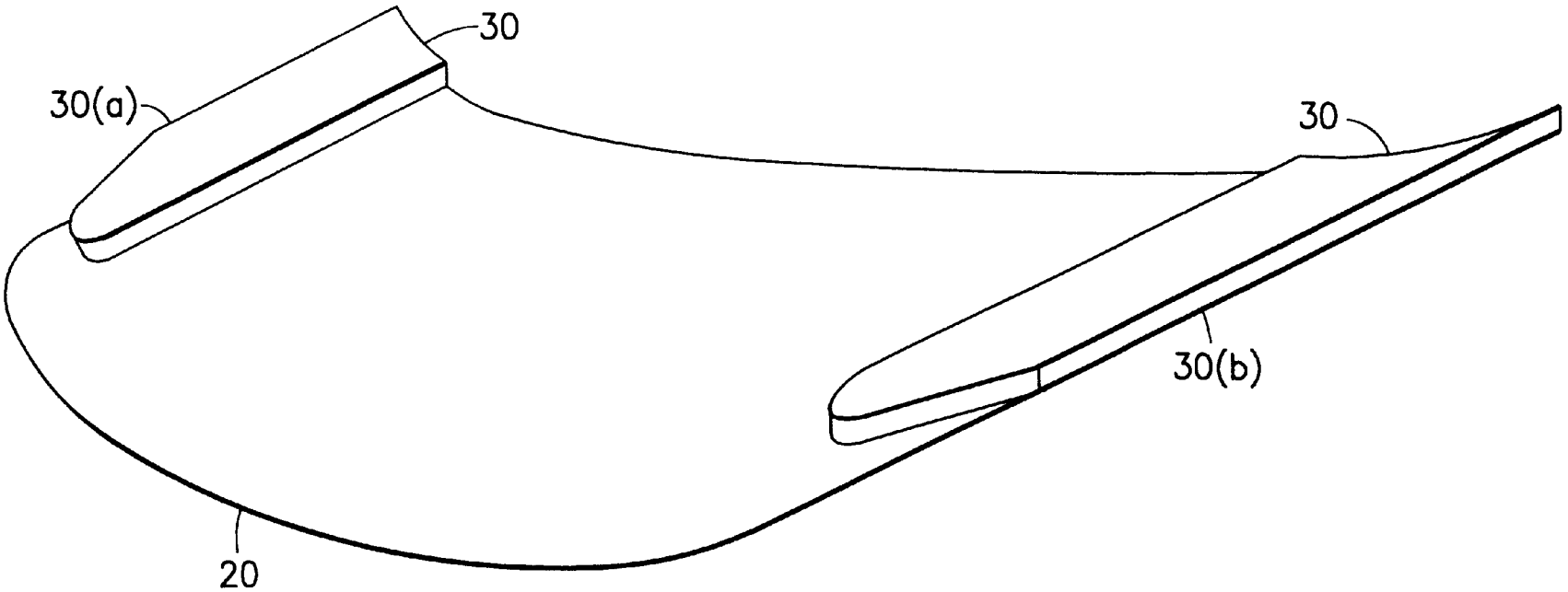
FIG. 3 is an underside view of the detachable visor cover by itself, showing the slide/track system.

FIG. 3 shows an underside view of the detachable visor cover 20 including the two opposite edges of a slide/track system 30 which is comprised of a slide track groove disposed at and/or affixed to the left side of the underside of the detachable visor cover 30(*a*) and a slide track groove disposed at and/or affixed to the right side of the underside of the detachable visor cover 30(*b*). As shown therein, the opposite edges, along a substantial length thereof, form said slide track grooves.

Figure 4:
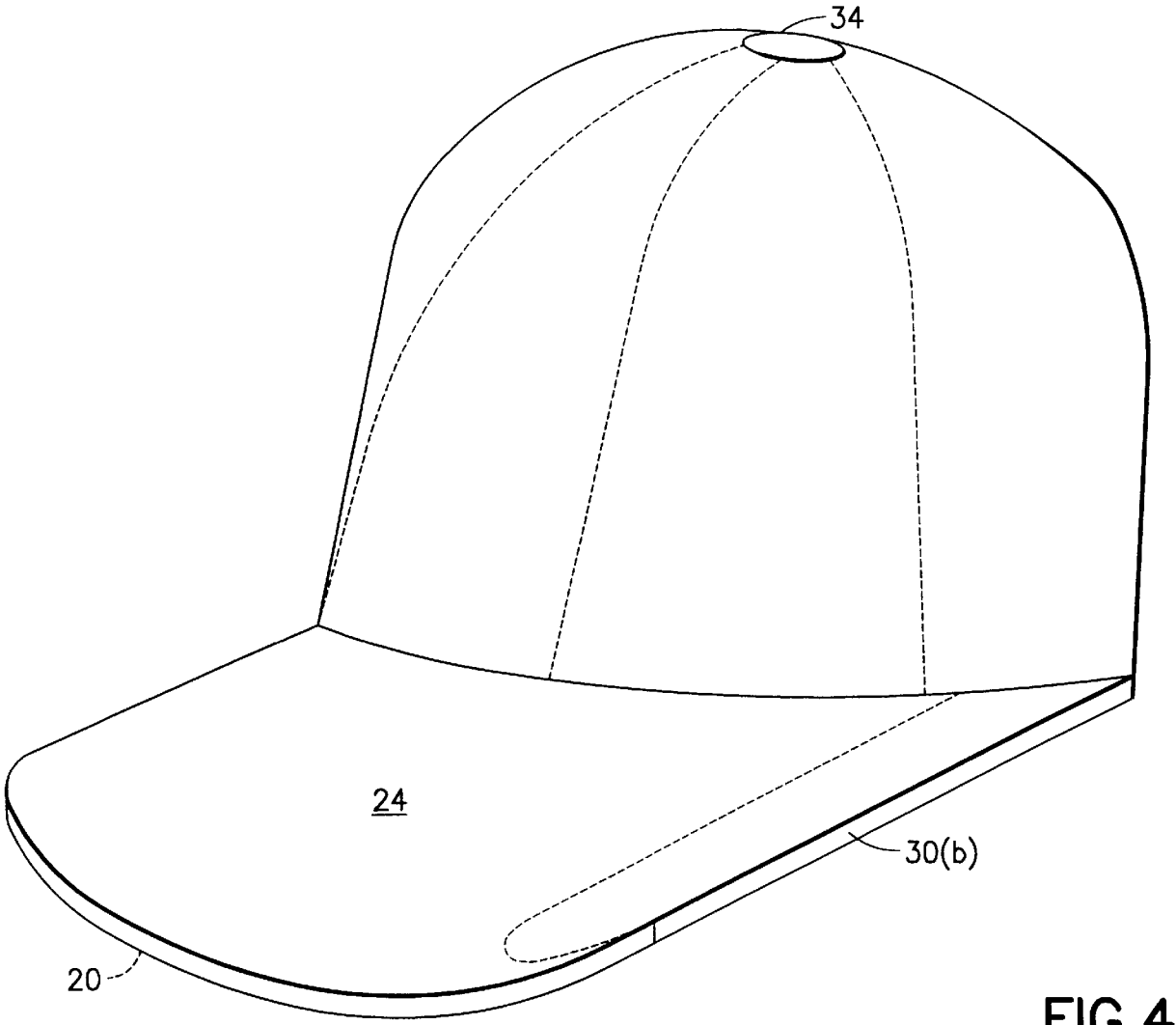
FIG. 4 is a top-side elevational side view of the detachable visor cover showing the slide/track system on one side, connected to the visor of a standard baseball cap.

FIG. 4 shows a side view of the detachable visor cover 20 with the right side of the slide/track system 30(*b*) affixed to the underside of the detachable visor cover 20, attached to the visor of a standard baseball cap 24 which is attached to the cap portion of a standard baseball cap 34.

Figure 5:
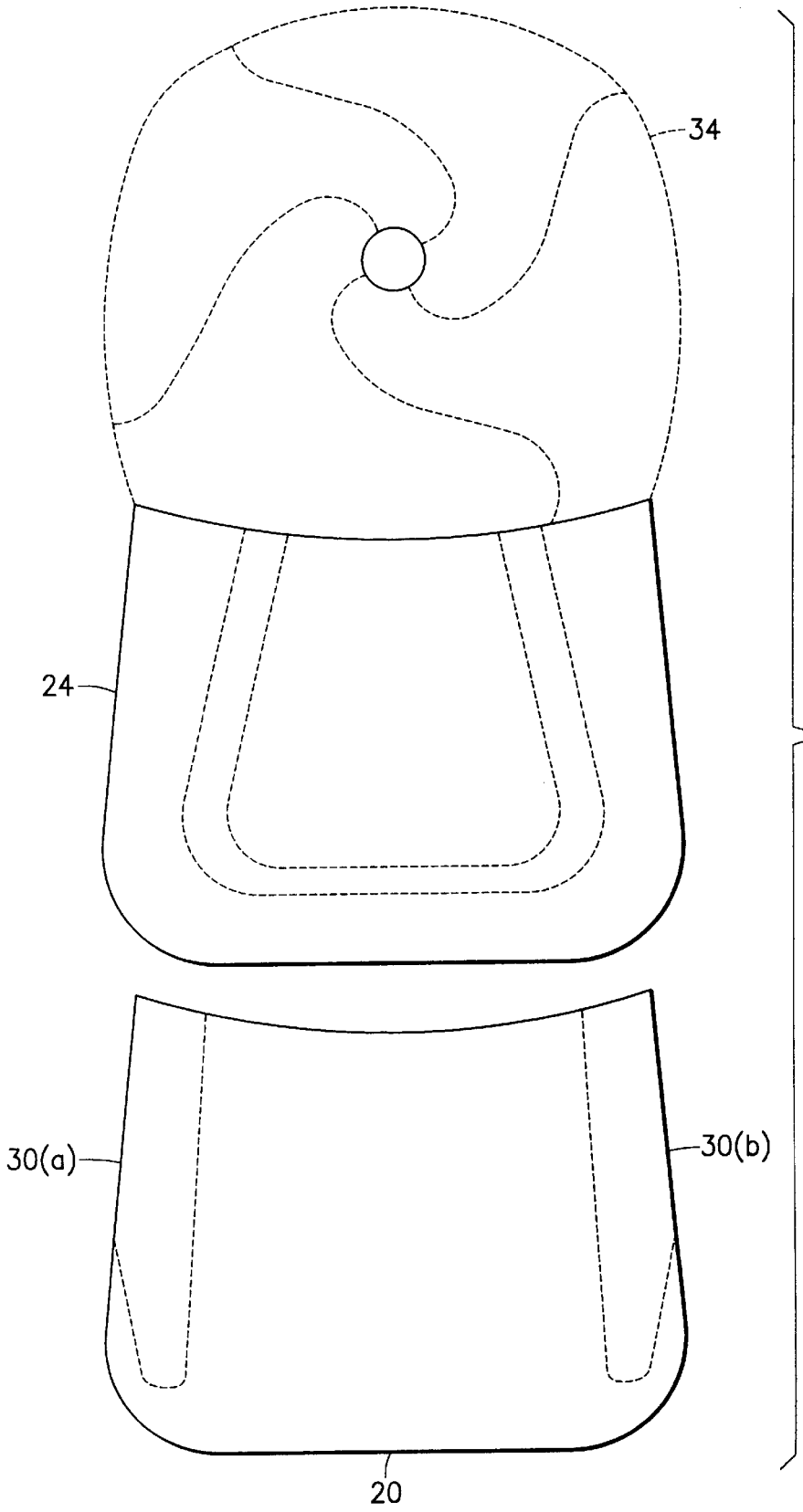
FIG. 5 is a top-side elevational view of the detachable visor cover showing proper positioning of the visor cover prior to attachment to a visor of a standard baseball cap.

FIG. 5 which focuses on the positioning of the detachable visor cover 20 shows that prior to attaching the detachable visor cover 20 to the visor of a baseball cap 24 the slide/tracks 30(*a*) and 30(*b*) respectively must be in line with the left and right sides of the visor of the baseball cap 24, which is attached to the cap portion of a standard baseball cap 34.

Figure 6:
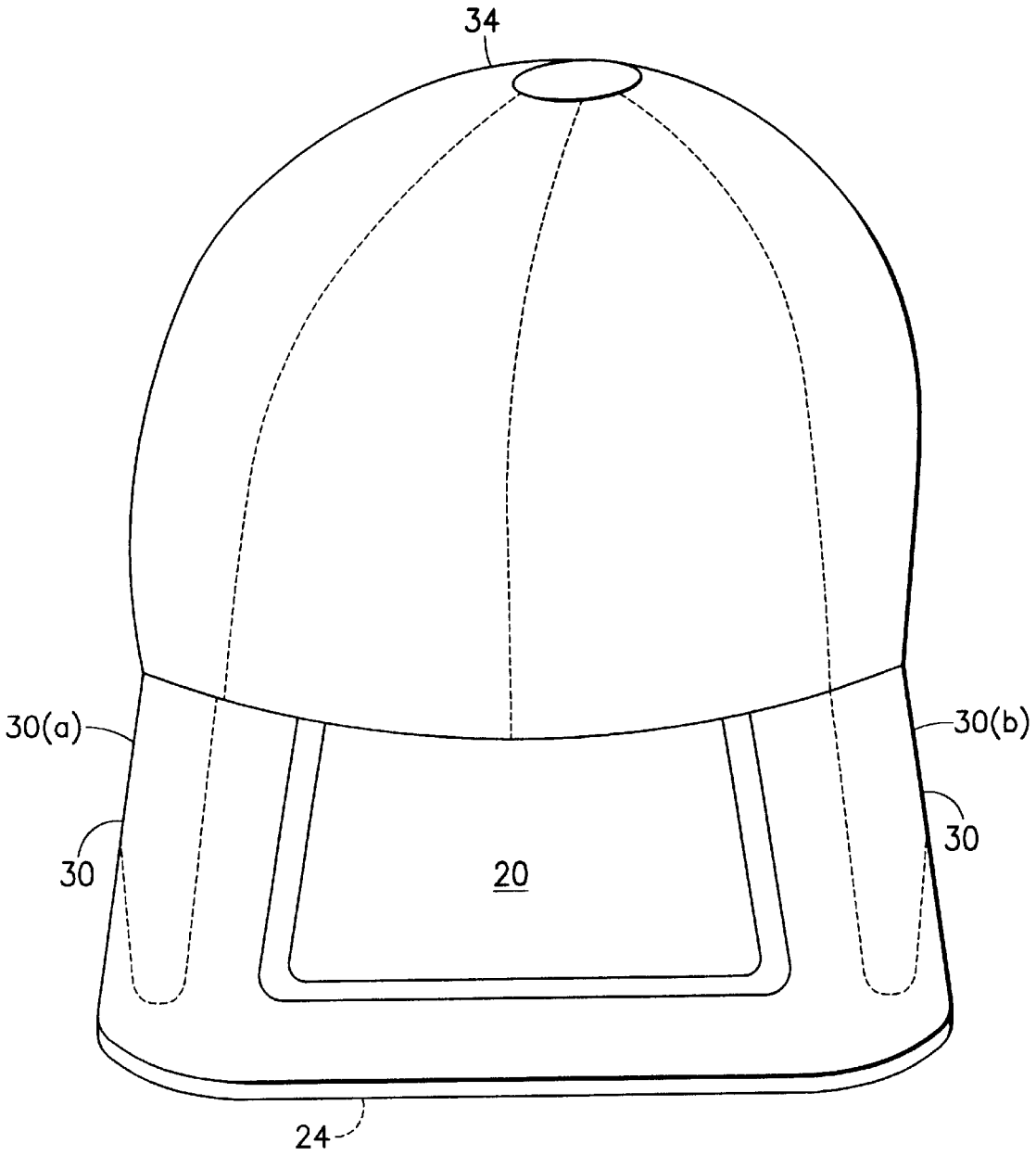
FIG. 6 is a frontal elevational view showing the slide/track system on both sides of the visor of the baseball cap.

FIG. 6 shows a frontal elevational view of the detachable visor cover 20 attached to the visor of a standard baseball cap 24 by use of the slide/track system 30 which is comprised of a slide track groove affixed to the left side of underside of the detachable visor cover 30(*a*) and a slide track groove affixed to the right side of underside of the detachable visor cover 30(*b*) which is attached to the cap portion of a standard baseball cap 34.

ADDITIONAL EMBODIMENTS RELATING TO THE TOP SIDE OF THE DETACHABLE VISOR COVER

In addition to the preferred embodiment, the following embodiments are also mentioned as additional items that may be featured on the top side of the detachable visor cover.

(a) A reflective device covering all or a portion of the top side of the detachable visor cover can be employed for night time use. The reflective device may be permanently or temporarily affixed to the detachable visor cover.

(b) A light-emitting device covering all or a portion of the top side of the detachable visor cover can be employed for runners or bicycle riders for night time use. The light-emitting device may be permanently or temporarily affixed to the detachable visor cover.

(c) A thin layer of colored or patterned material with logo attached may be suitably removed affixed by "Velcro" hook and loop fasteners to the top of a detachable visor. One could then buy a pack of, for example, several major league baseball team covers and one visor cover. This embodiment would allow one to purchase a multitude of team logos and colors or trade while purchasing just one detachable visor cover, but this embodiment would not be as simple to use as the preferred embodiment. This method would require more manipulation and the covers that would be affixed to the detachable visor cover may not be as durable.

(d) A detachable visor cover with recessed portion containing female receiving holes whereby a layer of colored or patterned material with logo attached is independently placed on a solid backing that contains male connectors on its underside to be connected to the female receiving holes that reside in the recessed portion of the detachable visor cover thus not adding any thickness to the detachable visor cover Again, as stated in embodiment (c) above one could purchase a multitude of team logos and colors while purchasing just one detachable visor cover. This method would still require more manipulation than the preferred embodiment and would contain more than one-piece as is shown in the preferred embodiment.

SUMMARY RAMIFICATIONS AND SCOPE

From the description above, a number of advantages of my detachable visor cover become evident:

(a) This design provides the wearer with a one-piece detachable visor cover that can be used with one's existing baseball caps.

(b) This design further eliminates the need for buttons, snaps, or hook and loop devices in order to attach the detachable visor cover to the visor portion of a baseball cap. The wearer simply slides on and slides off the detachable visor cover of one's choice.

(c) The detachable visor cover and slide/track system are composed of one solid piece of bendable molded material that provides a system for attachment that uses a minimum of parts and manipulation in order to use the device.

Accordingly, the reader will see that the detachable visor cover gives the wearer of the cap a simpler method of displaying variation of color and logos as does those described in the prior art. Furthermore, the detachable visor cover described herein has additional advantages in that this design, having the means of attachment built into the detachable visor cover provides an all inclusive device and provides the wearer with the ability to slide on and slide off the detachable visor cover of their choice. Besides providing ease of using the device, this design will support the ability to display different colors, logos, reflective devices, and holograms that, when attached to the visor of a baseball cap will appear as the actual visor.

Although the description above contains a number of specificities, these should not be construed as limiting the scope of the invention but as merely providing illustrations of some of the presently preferred embodiments of this invention. For example, the detachable visor cover can be composed whereby there is a left and right side section to the detachable visor cover but no middle section to the detachable visor cover. Then, the color of the actual visor would be visible and the colors composing the left and right portions of the detachable visor cover would be in contrast to the color of the actual visor color. This would increase even further the color, or pattern variation.

Thus the scope of the invention should be determined by the appended claims and their legal equivalents, rather than by the examples given.

We claim:

1. In combination with a cap, a visor cover for mounting on the cap, which is like a baseball/golf cap having a fixed, projecting, generally flat visor/bill of predetermined shape having opposing, generally straight side edges, without the use of any buttons, snaps or hook and loop fasteners, comprising:

a removable/interchangeable bill, of flexible material of predetermined thickness;

said removable/interchangeable bill having a shape which is generally like that of said baseball/golf cap's visor/bill, and having a front edge, a rear edge and pair of parallel side edges connecting said front and rear edges;

said side pair of parallel edges comprising generally parallel, slide tracks for mutual cooperative association with said opposing flat side edges of said projecting, generally flat visor/bill;

so that said visor cover can be easily mounted on said visor/bill of said cap, thereby enabling a user to quickly vary/change the look, color and/or logo of the visor/bill of said cap by sliding said parallel, slide tracks of said visor cover over said opposing flat side edges of said projecting, generally flat visor/bill.

2. The combination according to claim 1, wherein said detachable visor cover is selected from the group consisting of a visor cover of at least one color, a visor cover of a team's trade dress, a visor cover having a logo, a visor cover having a team or club name, a visor cover having an emblem, a visor cover having a hologram, a visor cover having a reflective device, a visor cover having an LED device and combinations thereof.

3. The combination according to claim 1, wherein said visor cover in one-piece.

4. The combination according to claim 3, wherein said side edges of said removable interchangeable bill have slide tracks.

5. The combination according to claim 4, wherein opposing wall surfaces of said side edges forming the slide tracks are spaced to detachably receive and retain in place said replaceable/interchangable bill by said opposing side edges of said bill of said cap.

6. The combination according to claim 3, wherein said visor cover is made of a bendable molded material.

* * * * *